US009607605B2

(12) United States Patent
Moosler et al.

(10) Patent No.: US 9,607,605 B2
(45) Date of Patent: Mar. 28, 2017

(54) ULTRASONIC SENSOR FOR CAPTURING VALUE DOCUMENTS AND METHOD FOR MANUFACTURING THE SAME

(75) Inventors: Hans-Uwe Moosler, Munich (DE); Oskar Dicklberger, Munich (DE); Joseph Lohner, Munich (DE); Frank Hermann, Munich (DE)

(73) Assignee: GIESECKE & DEVRIENT GMBH, Munich (DE)

( * ) Notice: Subject to any disclaimer, the term of this patent is extended or adjusted under 35 U.S.C. 154(b) by 350 days.

(21) Appl. No.: 14/126,927

(22) PCT Filed: Jun. 19, 2012

(86) PCT No.: PCT/EP2012/002583

§ 371 (c)(1),
(2), (4) Date: Dec. 17, 2013

(87) PCT Pub. No.: WO2012/175192

PCT Pub. Date: Dec. 27, 2012

(65) Prior Publication Data

US 2014/0140178 A1 May 22, 2014

(30) Foreign Application Priority Data

Jun. 20, 2011 (DE) ..... 10 2011 104 981

(51) Int. Cl.
*G10K 11/18* (2006.01)
*G07D 7/08* (2006.01)

(52) U.S. Cl.
CPC ..... *G10K 11/18* (2013.01); *G07D 7/08* (2013.01); *Y10T 29/49117* (2015.01)

(58) Field of Classification Search
CPC ..... G10K 11/18; G07D 7/08
(Continued)

(56) References Cited

U.S. PATENT DOCUMENTS 7,748,274 B2 7/2010 Pellaton et al.
7,795,785 B2 9/2010 Hayashi et al.
(Continued)

FOREIGN PATENT DOCUMENTS

DE 19921217 A1 11/2000
DE 102008039221 A1 3/2010
(Continued)

OTHER PUBLICATIONS

German to English Machine Translation of EP 2415679.*
International Search Report for corresponding International PCT Application No. PCT/EP2012/002583, mailed Sep. 24, 2012.

*Primary Examiner* — James Hulka
*Assistant Examiner* — John T Nolan
(74) *Attorney, Agent, or Firm* — Workman Nydegger

(57) ABSTRACT

An ultrasonic sensor and method for using the same are arranged for capturing a value document transported through a capture region of the ultrasonic sensor. The ultrasonic sensor has an ultrasound transmitter arranged for emitting ultrasound into the capture region and an ultrasound receiver arranged for receiving ultrasound from the ultrasound transmitter from the capture region. A control and evaluation circuit is arranged for controlling the ultrasound transmitter and for capturing and evaluating the signals of the ultrasound receiver. A circuit carrier carries the control and evaluation circuit, the ultrasound transmitter, the ultrasound receiver, and conducting paths electrically connecting the control and evaluation circuit to the first and second ultrasonic transducers. The circuit carrier has a U-shaped configuration and two interconnected arm portions, and the ultrasound transmitter is held on one of the two arm portions and the ultrasound receiver on the other of the two arm portions.

17 Claims, 2 Drawing Sheets

(58) Field of Classification Search
USPC ..... 367/96
See application file for complete search history.

(56) References Cited

U.S. PATENT DOCUMENTS

| | | | | |
|---|---|---|---|---|
| 2008/0289428 | A1 | 11/2008 | Hayashi et al. | |
| 2009/0260440 | A1* | 10/2009 | Pellaton | G01N 29/11 73/600 |
| 2013/0104660 | A1 | 5/2013 | Lohner et al. | |

FOREIGN PATENT DOCUMENTS

| | | | | |
|---|---|---|---|---|
| DE | 202010011113 | U1 | 11/2010 | |
| DE | 102010026341 | A1 | 1/2012 | |
| DE | EP 2415679 | * | 2/2012 | B65C 9/42 |
| EP | 1986465 | A1 | 10/2008 | |
| WO | 2007017663 | A1 | 2/2007 | |

* cited by examiner

ULTRASONIC SENSOR FOR CAPTURING VALUE DOCUMENTS AND METHOD FOR MANUFACTURING THE SAME

BACKGROUND

The present invention relates to an ultrasonic sensor for capturing a value document transported through a capture region of the ultrasonic sensor, and to a method for manufacturing such an ultrasonic sensor.

SUMMARY

Value documents are understood here to be sheet-shaped objects that represent for example a monetary value or an authorization and hence should not be manufacturable arbitrarily by unauthorized persons. They hence have features that are not simple to manufacture, in particular to copy, whose presence is an indication of authenticity, i.e. manufacture by an authorized body. Important examples of such value documents are chip cards, coupons, vouchers, checks and in particular bank notes.

Ultrasonic sensors of the above-mentioned kind can be configured for at least two different purposes. On the one hand, they can be configured for locally resolved capture of ultrasonic properties of a value document; on the other hand, they can be configured for transport monitoring, for example recognizing the presence of a value document in the capture region and/or the arrival of a leading or trailing edge of the value document, regarded in the transport direction.

In a typical arrangement, an ultrasonic transducer which emits ultrasound stands opposite an ultrasonic transducer which receives ultrasound. The two form an ultrasound path between each other.

The manufacture of such ultrasonic sensors and also their mounting on or in a value-document processing device involves some effort, because the ultrasonic transducers must be fastened in mutual alignment, and their electrical terminals be connected to control and evaluation circuits.

The present invention is hence based on the object of providing an ultrasonic sensor for capturing a value document transported through a capture region of the ultrasonic sensor, which enables a simple manufacture. There should further be stated a method for manufacture thereof.

This object is achieved by an ultrasonic sensor for capturing a value document which is transported through a capture region of the ultrasonic sensor, having an ultrasound transmitter and an ultrasound receiver which are so arranged that ultrasound is emittable by the ultrasound transmitter into the capture region and the ultrasound transmitter's ultrasound coming from the capture region is receivable by the ultrasound receiver, having a control and evaluation circuit for controlling the ultrasound transmitter and for capturing and evaluating signals of the ultrasound receiver, and a circuit carrier on which the control and evaluation circuit, the ultrasound transmitter and the ultrasound receiver as well as conducting paths electrically connecting the control and evaluation circuit to the first and second ultrasonic transducers are held, the circuit carrier being of U-shaped configuration and having two interconnected arm portions, and the ultrasound transmitter being held on one of the two arm portions and the ultrasound receiver on the other of the two arm portions.

The object is further achieved by a method for manufacturing an ultrasonic sensor, in particular an ultrasonic sensor according to the invention, wherein a U-shaped circuit carrier having two interconnected arm portions and conducting paths configured on the circuit carrier is manufactured, an ultrasound transmitter and an ultrasonic transducer are so connected to the U-shaped circuit carrier, while forming an electric connection with conducting paths provided for connecting the ultrasonic transducers, that the ultrasound transmitter is held on one of the two arm portions and the ultrasound receiver on the other of the two arm portions, and that ultrasound is emittable by the ultrasound transmitter into the capture region and the ultrasound transmitter's ultrasound coming from the capture region is receivable by the ultrasound receiver.

The ultrasonic sensor has the U-shaped circuit carrier having the two arm portions between which a value document is at least partly transportable through for capture by the ultrasonic sensor, more precisely, by the ultrasound transmitter held on the one arm portion and the ultrasound receiver held on the other arm portion. The ultrasound transmitter and the ultrasound receiver thus form an ultrasound path along which ultrasound can be emitted by the ultrasound transmitter and—in the absence of a value document—pass directly to the ultrasound receiver.

The circuit carrier can in principle be of arbitrary configuration, apart from its U-shaped configuration. There is preferably employed as a circuit carrier a U-shaped printed board. However, if necessary, it would also be possible to employ circuit carriers that are not configured in a board shape. For example, the arm portions could also have a rectangular, in particular square, or a circular cross section in a sectional plane transversely to the longitudinal direction of the arm portions.

On the circuit carrier there is preferably also held the control and evaluation circuit which is configured for controlling the ultrasound transmitter and for evaluating the signals of the ultrasound receiver.

The ultrasonic sensor according to the invention is hence characterized in particular by both the ultrasound transmitter and the ultrasound receiver being held on the same, i.e. only one, circuit carrier, which simultaneously enables the electrical contacting of ultrasound transmitter and ultrasound receiver. Hence, it is unnecessary to separately install ultrasound transmitter and ultrasound receiver in a housing, mutually align them and then contact them. The manufacture of the ultrasonic transducer according to the invention is thus considerably simplified.

The component group having the circuit carrier and, arranged thereon, the ultrasound transmitter, the ultrasound receiver and also the control and evaluation circuit can be simply handled as a whole. In particular, the U-shaped circuit carrier having the ultrasound transmitter held thereon and the ultrasound receiver held thereon can be incorporated into a sensor housing of the ultrasonic sensor. Said sensor housing can be one- or multi-part. According to a preferred embodiment, the sensor housing can be so configured that the circuit carrier is insertable thereinto in a direction parallel to the longitudinal direction of the arm portions; upon employment of a printed board as a circuit carrier, parallel to the plane of the printed board. This enables the sensor housing to be especially robust. According to another embodiment there can be provided a sensor housing having two housing members which is so configured that the circuit carrier is fastenable in or on one of the housing members.

If the circuit carrier employed is a printed board, the ultrasound transmitter and ultrasound receiver are preferably so arranged and held that their main emitting direction and main receiving direction respectively enclose an angle smaller than 5° with a plane formed by the printed board. In the method, the ultrasound transmitter and the ultrasound receiver can be accordingly aligned and connected to the printed board. The main emitting direction or main receiving direction is understood here to be that direction relative to the ultrasound transmitter or ultrasound receiver in which the greatest ultrasound intensity is emitted or the sensitivity to incoming ultrasound is maximal. In the case of several maxima, an average value is formed from the directions in which the maxima lie. This alignment signifies an especially good mutual alignment of ultrasound transmitter and ultrasound receiver.

The ultrasound transmitter and the ultrasound receiver can be identically or differently configured and/or connected to the circuit carrier. According to a first preferred alternative, the ultrasound transmitter and/or the ultrasound receiver can possess connector pins for electrical and preferably also mechanical connection with the circuit carrier. Thus, the connector pins can be soldered to corresponding portions of the conducting paths; if the circuit carrier employed is a printed board, the connector pins preferably extend with their longitudinal direction along the printed board. The connector pins can also be inserted into accordingly designed contact sleeves on or in the circuit carrier that are electrically connected to the conducting paths. In both cases there results through the two connector pins a torsionally stiff and highly electrically conductive connection which allows a stable alignment and secure electrical connection.

According to a second preferred alternative, the ultrasound transmitter and/or the ultrasound transmitter can also have an ultrasonic transducer module having a mounting module with a module housing and a mounting module printed board with conducting paths applied thereto and an ultrasonic transducer held in the mounting module. At least two of the mounting module conducting paths of the mounting module are then electrically connected to connecting strands of the ultrasonic transducer and have contact areas which are so configured that the ultrasonic transducer module is placeable for mounting on the circuit carrier on which there are located contact areas complementary to said contact areas and electrically connected to the conducting paths, and the contact areas and the complementary contact areas are solderable to each other. This likewise allows a simple and secure mounting of the ultrasonic transducer modules on the circuit carrier. Ultrasonic transducer modules of the stated kind are described in the applicant's German patent application with the number 102010026341, whose content is hereby incorporated in this application by reference.

Further, it is preferred that at least one of the ultrasound transmitter and the ultrasound receiver has a housing bottom which faces away from a, or the main, emitting direction or receiving direction of the ultrasound transmitter or ultrasound receiver, and the housing bottom adjoins the edge of the circuit carrier, preferably of the printed board. This facilitates not only the alignment during mounting on the printed board, but also increases the stability of the alignment of the ultrasound transmitter or ultrasound receiver when it is held on the circuit carrier.

Alternatively or cumulatively, the edge of the circuit carrier, preferably of the printed board, can have a receiving means for the ultrasound transmitter or ultrasound receiver in which the ultrasound transmitter or ultrasound receiver is arranged. This allows a simpler alignment of the ultrasound transmitter or ultrasound receiver upon mounting. The receiving means can preferably be given by a recess in the circuit carrier, preferably the printed board, which has a width which is only little greater than the corresponding width of that portion of the ultrasound transmitter or ultrasound receiver that is arranged in the region of the receiving means in the finished state of the ultrasonic sensor. Preferably, a gap between the edge of the recess and the portion is smaller than 2 mm, particularly preferably smaller than 1 mm.

An ultrasonic sensor according to the invention only needs to have one ultrasound transmitter or ultrasound receiver. However, the ultrasonic sensor preferably has at least one further ultrasound transmitter and one further ultrasound receiver which are both so held on the arm portions of the printed board that ultrasound from the further ultrasound transmitter is emittable into the capture region and the further ultrasound transmitter's ultrasound coming from the capture region is receivable by the further ultrasound receiver. There is thus provided at least one further ultrasound path which preferably extends parallel to the above-mentioned ultrasound path.

Preferably, the further ultrasound transmitter and the further ultrasound receiver are configured or arranged as described hereinabove for the ultrasound transmitter and ultrasound receiver, the circuit carrier being modified accordingly. In particular, the latter can have configured thereon further conducting paths which electrically connect the further ultrasound transmitter and the further ultrasound receiver to the control and evaluation circuit. The latter can control the ultrasound transmitter and the further ultrasound transmitter independently of each other or jointly and/or evaluate signals of the ultrasound receiver and the further ultrasound receiver independently of each other or jointly.

BRIEF DESCRIPTION OF THE DRAWING

The invention will hereinafter be explained further by way of example with reference to the drawings. There are shown.

DETAILED DESCRIPTION OF VARIOUS EMBODIMENTS

Figure 1:
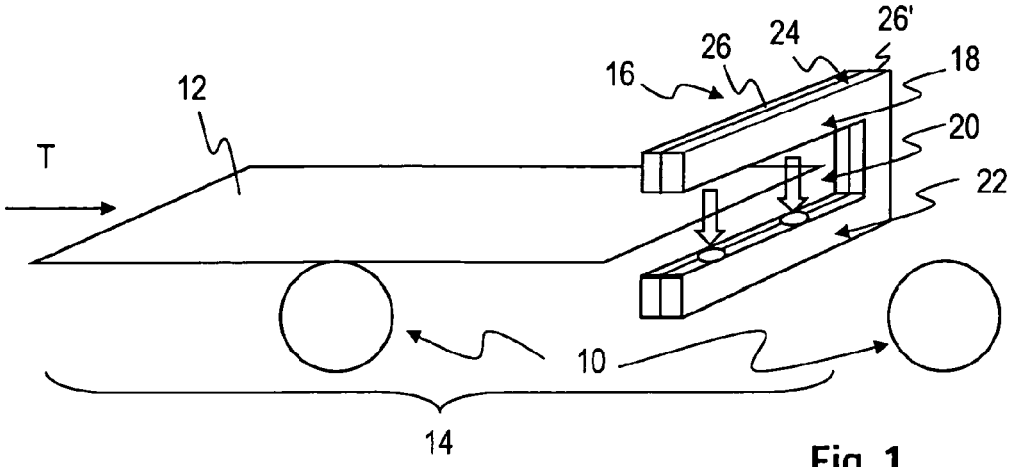
FIG. 1 a schematic view of a portion of a bank-note transport path of a bank-note processing apparatus having an ultrasonic sensor, FIG. 2 a schematic view of a printed board of the ultrasonic sensor in FIG. 1 in a housing member of the ultrasonic sensor in FIG. 1, on which board the ultrasonic transducers and components are arranged, FIG. 3 a schematic view of the printed board in FIG. 2 parallel to the area of the printed board, FIG. 4 a schematic view of an ultrasonic transducer module of the ultrasonic sensor in FIG. 1, FIG. 5 a schematic perspective view of an ultrasonic transducer module of an ultrasonic sensor modified over the ultrasonic sensor in FIG. 2, and FIG. 6 a schematic side view of the ultrasonic transducer module in FIG. 5 after connection with a printed board of the ultrasonic sensor.

FIG. 1 shows a portion of a transport device 10 for value documents which is part of a value-document processing apparatus not shown in detail, in the example a bank-note processing apparatus. The transport device 10 is configured for transporting a value document in the form of a bank note 12 along a transport path 14 given by the transport device 10. For this purpose, it can have elements driven by a motor (not shown) which are indicated only symbolically in FIG. 1, such as for example transport rollers or transport belts which move and/or guide the value document.

On the portion of the transport device 10 there is arranged an ultrasonic sensor 16 which is configured for capturing value documents, i.e. in this example bank notes, which are transported along the transport path 14 in the transport direction T.

The ultrasonic sensor 16 has a transmitting portion 18 for emitting ultrasound into a capture region 20 and a receiving portion 22 which captures ultrasound emitted by the transmitting portion 18 and coming from the capture region 20. The ultrasonic sensor 16 is so arranged that the transport path 14 leads through the capture region 20, so that value documents transported along the transport path 14 can be captured by the ultrasonic sensor 16. When a value document passes into the capture region 20 it attenuates the ultrasound emitted by the transmitting portion 18 onto the receiving portion 22 on its way to the receiving portion 22. Through evaluation of the receive signals in the capture portion 22 or from the capture portion 22, which represent a property of the received ultrasound, for example its intensity, one can hence infer the presence of the value document and/or its ultrasonic properties.

The ultrasonic sensor 16 will now be described more exactly with reference to FIGS. 1 to 3.

The ultrasonic sensor 16 possesses a U-shaped housing 24 which consists of two halves 26 and 26' which are interconnectable or interconnected by means of a snap connection (not shown).

Figure 2:
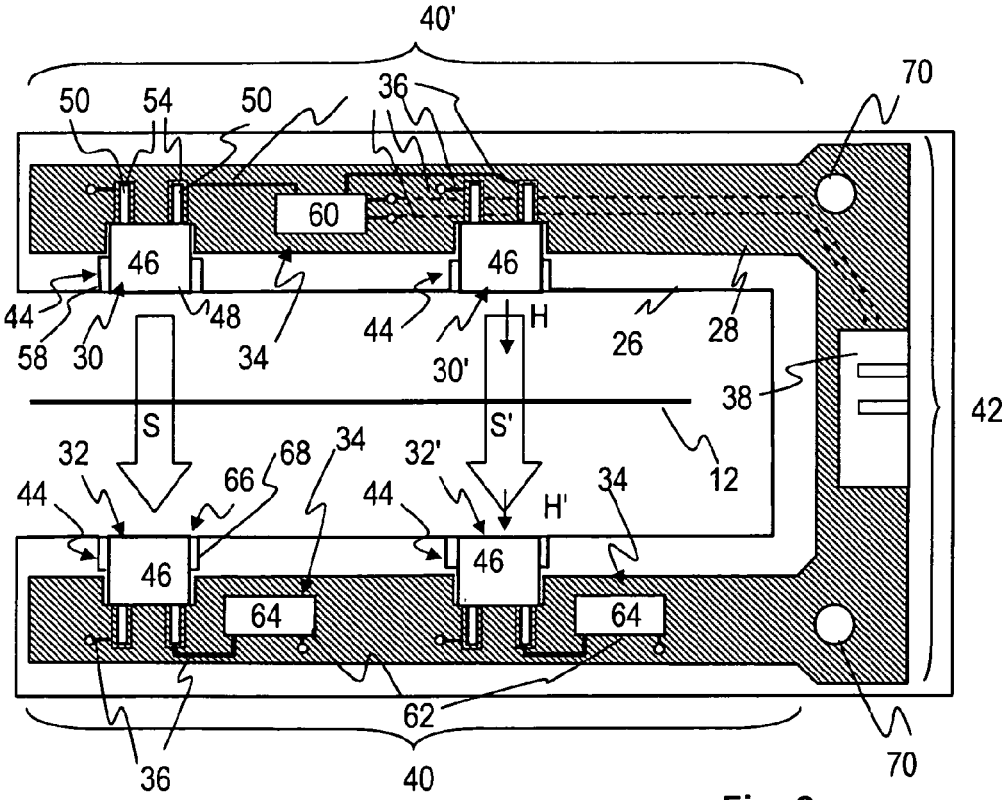
Figure 3:
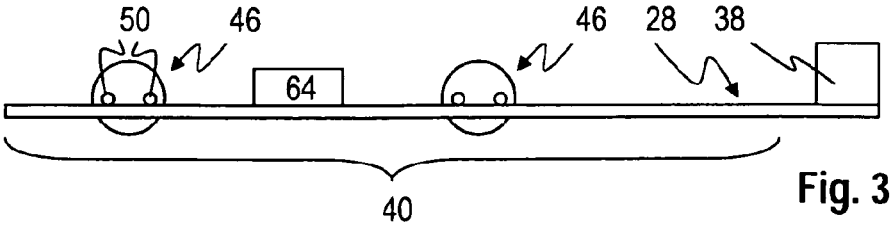

The ultrasonic sensor 16 has in the housing 24 a U-shaped circuit carrier, in the example a U-shaped printed board 28, which is shown by hatching in FIG. 2 for better recognizability. On the printed board 28 there are configured two ultrasound transmitters 30 and 30', two ultrasound receivers 32 and 32', a control and evaluation circuit 34 and, only partly shown in FIG. 2 for clarity's sake, conducting paths 36 configured on the upper side and/or underside of the printed board 28 for connecting the ultrasound transmitters 30, 30' and the ultrasound receivers 32 and 32' to the control and evaluation circuit 34. Further there is held on the printed board a plug connector 38 which is connected to the control and evaluation circuit 34 by means of conducting path portions applied to the printed board 28, which are likewise shown only partly in FIG. 2.

The U-shaped printed board 28 is configured in one piece and possesses two arm portions 40 and 40' which are interconnected by a connecting portion 42.

On the inner edge of the arms 40 and 40' there are configured mutually opposing receiving means 44 in the form of gaps whose edges extend parallel.

The receiving means 44 and therein the ultrasound transmitters 30 and 30' as well as ultrasound receivers 32 and 32' are so arranged that the ultrasound transmitter 30 and the ultrasound receiver 32, on the one hand, and the ultrasound transmitter 30' and the ultrasound receiver respectively form an ultrasound path S, S'. This means that the respective ultrasound transmitter and the respective ultrasound receiver are so aligned that ultrasound emitted by the ultrasound transmitter is emitted through the capture region to the ultrasound receiver. The ultrasound transmitters 30 and 30' are held on the arm portion 40 and the ultrasound receivers 32 and 32' on the opposing arm portion 40'.

Figure 4:
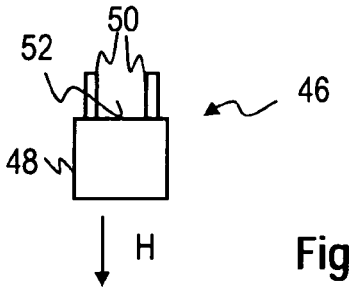

The ultrasound transmitters 30 and 30' and the ultrasound receivers 32 and 32' are identically configured in the present exemplary embodiment, and comprise ultrasonic transducer modules 46, shown schematically but enlarged in FIG. 4, which comprise an ultrasonic transducer not shown in the figures which is arranged in a module housing 48 and connected via strands to connector pins 50 serving for electrical connection which are rigid or hard to bend compared to a strand and protrude from the module housing 48. The connector pins 50 are held in the module housing 48 without play and protrude from a housing bottom 52 which is plane in this example.

The ultrasonic transducer modules 46 are so configured that their main emitting direction H or main receiving direction H (direction of highest sensitivity to ultrasound) is aligned at least approximately perpendicularly to the housing bottom 52 of the module housing, i.e. these directions enclose an angle smaller than 5°, preferably smaller than 3°, with a normal to the housing bottom 52 when the latter is plane as in this example. The housing bottom 52 thus in particular faces away from the main emitting direction or main receiving direction.

Further, in this exemplary embodiment the connector pins 50 are so held in the ultrasonic transducer module 46 that they penetrate the housing bottom 52 on a diameter of the circular housing bottom 52 at least approximately, preferably with a deviation of less than 1 mm.

Further, in this exemplary embodiment the directions H are approximately parallel to the longitudinal direction of the connector pins 50. The connector pins 50 are soldered to corresponding electroconductive contact areas connected to the conducting paths 36, as illustrated schematically in FIG. 2 by the lines 54. The connector pins extend with their longitudinal direction parallel to the printed board 28 or rest thereon, apart from deviations caused by the soldered connection.

Due to the arrangement of the connector pins 50 relative to the housing bottom 52, the ultrasound paths extend between the arm portions 40 and 40' of the printed board 28.

Furthermore, the ultrasonic transducer modules 46 are so arranged in the receiving means 44 that the distance between the respective housing bottom 52 and the edge of the printed board 28 is smaller than 1 mm, preferably smaller than 0.5 mm. Very particularly preferably, the housing bottom 52 adjoins the edge of the printed board 28.

The ultrasonic transducer modules 46 and in this exemplary embodiment in particular the connector pins 50 are so arranged on the printed board 28 that their main emitting directions H, H' respectively enclose an angle smaller than 5° with a plane formed by the printed board 28.

The width of the receiving means 44 and the diameters of the ultrasonic transducer modules 46 or their module housings are mutually coordinated such that the distance between the housing shell 56 and the lateral limit 58 of the receiving means 44 is smaller than 2 mm, preferably smaller than 1 mm. This allows a simple and exact mounting of the ultrasonic transducer modules and simultaneously prevents a breakage of the soldered connection through a motion parallel to the longitudinal axis of the arm portions 40, 40'.

In this way, the connector pins fulfill two different functions. On the one hand, they serve to electrically connect the ultrasonic transducer modules to the control and evaluation circuit 34. On the other hand, they serve as a mechanical fastening for the ultrasonic transducer modules 46 on the printed board 28 and thus in particular also for mutually aligning the ultrasonic transducer modules 46 as transmitter and receiver, so as to form the above-mentioned ultrasound paths which extend across the capture region 20.

The control and evaluation circuit 34 serves to control the ultrasound transmitters 30 and 30' and to capture and evaluate signals of the ultrasound receiver 32, 32'. It is shown incompletely in the figures for clarity's sake. The control and evaluation circuit 34 comprises a control portion 60 held on the printed board 28 and connected to the plug connector 38 via conducting paths on the printed board 28, said control portion likewise being electrically connected via conducting paths on the printed board 28 via the soldering points 54 to the connector pins of the ultrasound transmitters 30 and 30' and serving to control the ultrasound transmitters 30 and 30'. The conducting paths between plug connector 38 and control portion 60 extend partly on the side of the printed board 28 that is not visible in FIG. 2 and are hence only dashed in this figure.

The control and evaluation circuit 34 further has an evaluation portion 62 which is connected via conducting paths on the printed board 28 to the plug connector 38 in order to allow an access to the signals. The evaluation portion 62 has in particular two receive circuits 64, 64' which are connected via conducting paths on the printed board 28 via the soldering points 54 to the connector pins of the ultrasound receivers 32, 32', and held on the printed board 28.

The housing half-members 26 and 26' of the housing 24 are so configured that the housing 24 possesses, in the region of the ultrasonic transducer modules 46, openings 66 with adjoining cylindrical wall portions 68 pointing into the interior of the housing, said wall portions having portions of the ultrasonic transducer modules arranged therein. To prevent dust from entering, on the one hand, and for undisturbed emission of ultrasound and undisturbed reception of ultrasound, on the other hand, the openings 66 and the cylindrical wall portions 68 have a slightly greater diameter than the ultrasonic transducer modules 46.

The manufacture of such an ultrasonic sensor can be effected very simply. First, the printed board 28 having the conducting paths 36 is manufactured. Then there are connected thereto the control and evaluation circuit 34, the plug connector 38 and the ultrasound transmitters 30, 30' and ultrasound receivers 32, 32' by soldered connections. In so doing, the ultrasound transmitters 30, 30' and ultrasound receivers 32, 32' are mutually aligned.

In this state a test of the ultrasonic sensor can already be carried out without the housing, if desired.

Finally, the printed board 28 having the components soldered thereto is merely placed in a housing half-member, for example the housing half-member 26, and connected thereto, for example by means of screws guided through fastening holes 70 in the printed board 28 and screwed into fastening elements in the housing half-member.

Figure 5:
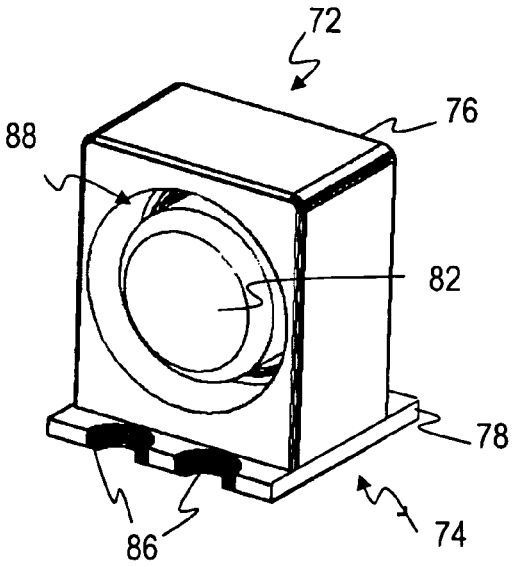
Figure 6:
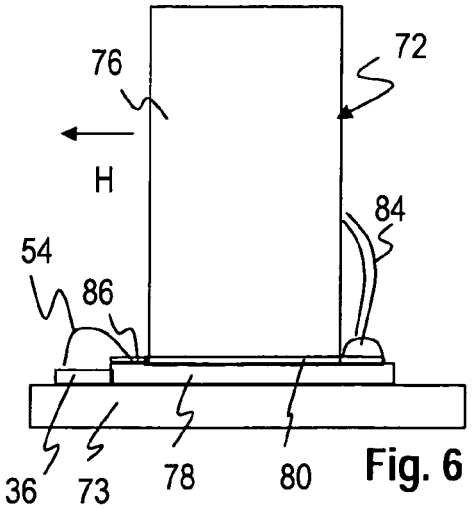

A second exemplary embodiment in FIGS. 5 and 6 differs from the first exemplary embodiment only in that there are employed ultrasonic transducer modules 72 which are placed on the corresponding printed board 73 modified over the printed board 28, and soldered thereto. Such ultrasonic transducer modules are described in the applicant's German patent application with the application number 102010026341.

For this purpose, the printed board 73 is changed over the printed board 28 only to the extent that it allows a mounting of the ultrasonic transducer modules on the printed board 73. The same reference signs are hence employed for mutually corresponding parts, and the comments thereon hold here accordingly.

The ultrasonic transducer modules 72 are identically configured, so that it suffices to describe more exactly only one. It comprises a mounting module 74 having a module housing 76 and a mounting module printed board 78 having conducting paths 80 applied thereto, and an ultrasonic transducer 82 held in the mounting module 74, here the module housing 76. At least two of the mounting module conducting paths of the mounting module 74, here of the mounting module printed board 78, are electrically connected to connecting strands 84 of the ultrasonic transducer 82 and have contact areas 86 which are so configured that the ultrasonic transducer module is placeable for mounting on the printed board 73 on which there are located contact areas that are complementary to the contact areas 86, and the contact areas and the complementary contact areas are solderable to each other.

The ultrasonic transducers 82 are so held in receiving means 88 in the module housing 76 that they are aligned with their main emitting or receiving direction H parallel to the plane of the mounting module printed board 78. After mounting of the ultrasonic transducer modules on the printed board 73, these main emitting and receiving directions H are then aligned parallel to the plane of the printed board 73. The mutual alignment of the ultrasonic transducer modules is effected as in the first exemplary embodiment. It can be facilitated by the mounting module and the U-shaped printed board having mutually complementary aligning elements, for example pins and holes, by means of which the ultrasonic transducer module can be aligned relative to the printed board or is aligned after mounting.

The invention claimed is:

1. An ultrasonic sensor for capturing a value document transported through a capture region of the ultrasonic sensor, comprising:

first and second ultrasonic transducers including an ultrasound transmitter and an ultrasound receiver arranged so that ultrasound is emittable by the ultrasound transmitter into the capture region and the ultrasound transmitter's ultrasound coming from the capture region is receivable by the ultrasound receiver;

a control and evaluation circuit for controlling the ultrasound transmitter and for capturing and evaluating signals of the ultrasound receiver, and a circuit carrier on which the control and evaluation circuit, the ultrasound transmitter, the ultrasound receiver, and conducting paths electrically connecting the control and evaluation circuit to the first and second ultrasonic transducers are held, the ultrasound transmitter and the ultrasound receiver being held on the same circuit carrier, the circuit carrier being of U-shaped configuration and having two interconnected arm portions; and wherein the ultrasound transmitter is held on one of the two arm portions and the ultrasound receiver on the other of the two arm portions, and wherein the circuit carrier is a printed board.

2. The ultrasonic sensor according to claim 1, wherein the ultrasound transmitter and ultrasound receiver are so arranged that their main emitting direction and main receiving direction respectively enclose an angle smaller than 5° with a plane formed by the printed board.

3. The ultrasonic sensor according to claim 1, wherein the ultrasound transmitter and/or the ultrasound receiver possesses connector pins for electrical connection with the circuit carrier.

4. The ultrasonic sensor according to claim 3, wherein the connector pins extend along the printed board.

5. The ultrasonic sensor according to claim 1, wherein at least one of the ultrasound transmitter and the ultrasound receiver has a housing bottom which faces away from a main emitting direction or main receiving direction of the ultrasound transmitter or ultrasound receiver, and the housing bottom adjoins an edge of the circuit carrier.

6. The ultrasonic sensor according to claim 1, wherein the edge of the circuit carrier has a receiving means for the ultrasound receiver in which the ultrasound transmitter or ultrasound receiver is arranged.

7. The ultrasonic sensor according to claim 1, which has at least one further ultrasound transmitter and one further ultrasound receiver which are both so held on the arm portions of the circuit carrier that ultrasound is emittable by the further ultrasound transmitter into the capture region and the further ultrasound transmitter's ultrasound coming from the capture region is receivable by the further ultrasound receiver.

8. The ultrasonic sensor according to claim 1, wherein-the circuit carrier is a printed board, wherein the ultrasound transmitter and ultrasound receiver are so arranged that their main emitting direction and main receiving direction respectively enclose an angle smaller than 5° with a plane formed by the printed board, wherein the ultrasound transmitter and/or the ultrasound receiver possesses connector pins for electrical connection with the circuit carrier, wherein the connector pins extend along the printed board, wherein at least one of the ultrasound transmitter and the ultrasound receiver has a housing bottom which faces away from a main emitting direction or main receiving direction of the ultrasound transmitter or ultrasound receiver, and the housing bottom adjoins an edge of the circuit carrier, wherein the edge of the circuit carrier has a receiving means for the ultrasound receiver in which the ultrasound transmitter or ultrasound receiver is arranged, and wherein the ultrasonic sensor includes at least one further ultrasound transmitter and one further ultrasound receiver which are both so held on the arm portions of the circuit carrier that ultrasound is emittable by the further ultrasound transmitter into the capture region and the further ultrasound transmitter's ultrasound coming from the capture region is receivable by the further ultrasound receiver.

9. The ultrasonic sensor according to claim 1, wherein the one of the two arm portions of the circuit carrier is coplanar with the other of the two arm portions of the circuit carrier.

10. The ultrasonic sensor according to claim 1, wherein the ultrasound transmitter and the ultrasound receiver are aligned to transmit and receive ultrasound within a plane in which both the two arm portions of the circuit carrier extend.

11. A method for manufacturing an ultrasonic sensor configured to capture a value document transported through a capture region of the ultrasonic sensor, the method comprising:

providing first and second ultrasonic transducers that include an ultrasound transmitter and an ultrasound receiver;

providing a U-shaped circuit carrier which has two interconnected arm portions and conducting paths configured on the circuit carrier;

providing a control and evaluation circuit for controlling the ultrasound transmitter and for capturing and evaluating signals of the ultrasound receiver; and connecting the ultrasound transmitter and the ultrasonic receiver to the U-shaped circuit carrier such that the ultrasound transmitter is held on one of the two arm portions and the ultrasound receiver is held on the other of the two arm portions, the ultrasound transmitter and the ultrasound receiver being held on the same U-shaped circuit carrier, and ultrasound is emittable by the ultrasound transmitter into the capture region and the ultrasound transmitter's ultrasound coming from the capture region is receivable by the ultrasound receiver; and forming an electric connection with the conducting paths provided for connecting the control and evaluation circuit to the first and second ultrasonic transducers, wherein the one of the two arm portions of the circuit carrier is formed to be coplanar with the other of the two arm portions of the circuit carrier.

12. The method according to claim 11, wherein the U-shaped circuit carrier having the ultrasound transmitter held thereon and the ultrasound receiver held thereon are incorporated into a sensor housing of the ultrasonic sensor.

13. The method of claim 11, wherein the ultrasound transmitter and the ultrasound receiver are aligned to transmit and receive ultrasound within a plane in which both the two arm portions of the circuit carrier extend.

14. An ultrasonic sensor configured to capture a value document transported through a capture region of the ultrasonic sensor, the ultrasonic sensor comprising:

a U-shaped circuit carrier including a first arm portion interconnected to a second arm portion by a connecting portion;

an ultrasound transmitter held by the first arm portion and an ultrasound receiver held by the second arm portion such that ultrasound is emittable by the ultrasound transmitter into the capture region and the ultrasound transmitter's ultrasound coming from the capture region is receivable by the ultrasound receiver;

a control and evaluation circuit configured to control the ultrasound transmitter and to control a capture and evaluation of signals from the ultrasound receiver; and conducting paths configured to electrically connect the control and evaluation circuit to the ultrasound transmitter and to the ultrasound receiver, wherein first arm portion and the second arm portion are coplanar.

15. The ultrasonic sensor according to claim 14, wherein the ultrasound transmitter and the ultrasound receiver are aligned to transmit and receive ultrasound within a plane in which the first arm portion and the second arm portion extend.

16. The ultrasonic sensor according to claim 14, wherein the circuit carrier is a single printed board.

17. The ultrasonic sensor according to claim 16, wherein the ultrasound transmitter and ultrasound receiver are so arranged that their main emitting direction and main receiving direction respectively enclose an angle smaller than 5° with a plane formed by the printed board.

* * * * *